United States Patent [19]

Miller

[11] 4,397,741

[45] Aug. 9, 1983

[54] APPARATUS AND METHOD FOR SEPARATING PARTICLES FROM A FLUID SUSPENSION

[75] Inventor: Jan D. Miller, Salt Lake City, Utah

[73] Assignee: University of Utah, Salt Lake City, Utah

[21] Appl. No.: 323,336

[22] Filed: Nov. 20, 1981

Related U.S. Application Data

[63] Continuation-in-part of Ser. No. 182,524, Aug. 29, 1980, and a continuation-in-part of Ser. No. 94,521, Nov. 15, 1979, Pat. No. 4,279,743.

[51] Int. Cl.[3] ..... B03D 1/24

[52] U.S. Cl. ..... 209/170; 209/211; 210/512.1; 210/221.2

[58] Field of Search ..... 209/164, 165, 168, 170, 209/211; 210/512.1, 787–789, 703, 706, 221.2

[56] References Cited

U.S. PATENT DOCUMENTS

| | | | |
|---|---|---|---|
| 2,532,885 | 12/1950 | Berges | 209/211 |
| 2,849,930 | 9/1958 | Freeman et al. | 209/211 X |
| 2,879,889 | 3/1959 | Rakowsky | 209/173 |
| 3,557,956 | 1/1971 | Braun | 210/788 |

FOREIGN PATENT DOCUMENTS

| | | | |
|---|---|---|---|
| 545385 | 3/1977 | U.S.S.R. | 209/170 |
| 751437 | 7/1980 | U.S.S.R. | 209/168 |

*Primary Examiner*—Ralph J. Hill

*Attorney, Agent, or Firm*—H. Ross Workman; Allen R. Jensen; Dale E. Hulse

[57] ABSTRACT

An apparatus and method for separating particles from a fluid, particulate suspension by flotation in a centrifugal field. The apparatus includes a vertically oriented, cylindrical vessel having a tangential inlet and a tangential outlet. The particulate suspension is introduced into the vessel through the inlet and swirls around the inner surface of the vessel in a thin fluid layer. Air is sparged through a porous wall formed in the vessel and into the thin fluid layer of the particulate suspension. Small bubbles are generated at the surface of the porous wall. The directed motion of the particles in the thin layer of particulate fluid suspension results in a high probability for collision and a rapid flotation. The air bubbles and particles form bubble/particle aggregates which migrate towards the axial center of the apparatus and into a froth phase in the core of the apparatus. The particle-containing froth travels upwardly, countercurrently to the thin fluid layer, and is removed coaxially through a vortex finder.

15 Claims, 5 Drawing Figures

APPARATUS AND METHOD FOR SEPARATING PARTICLES FROM A FLUID SUSPENSION

BACKGROUND

1. Related Applications

This application is a continuation-in-part application of my copending application Ser. No. 182,524, filed Aug. 29, 1980, entitled FLOTATION APPARATUS AND METHOD FOR ACHIEVING FLOTATION IN A CENTRIFUGAL FIELD and a continuation-in-part application of my application Ser. No. 094,521, filed Nov. 15, 1979, entitled AIR-SPARGED HYDROCYCLONE AND METHOD which issued as U.S. Pat. No. 4,279,743 on July 21, 1981.

2. The Field of the Invention

The present invention relates to a novel apparatus and method for separating particles from a fluid, particulate suspension by flotation in a centrifugal field.

3. The Prior Art

A. Flotation Processes

Flotation is a process in which the apparent density of one particulate constituent of a suspension of finely dispersed particles is reduced by the adhesion of gas bubbles to that respective particulate constituent. The buoyancy of the bubble/particle aggregate is such that it rises to the surface and is thereby separated by gravity from the remaining particulate constituents. While the particulates which attract air form bubble/particle aggregates and "float" to the surface, the other particulates of the suspension do not attract air and, therefore, remain suspended in the liquid phase of the suspension.

The preferred method for removing the floated material is to form a froth or foam to collect the bubble/particle aggregates. The froth containing the collected bubble/particle aggregates can then be removed from the top of the suspension. This process is called froth flotation and is conducted as a continuous process in equipment called flotation cells. It is important to realize that froth flotation is encouraged by voluminous quantities of small bubbles (such as in the range of one to two millimeters in diameter).

In conventional processes, the success of flotation has depended upon controlling conditions in the suspension so that the air is selectively retained by one particle constituent and rejected by the other constituents of the particulate suspension. To attain this objective, the feed must be treated by the addition of small amounts of known chemicals which render one constituent hydrophobic, thus causing that constituent to be repelled by the aqueous environment and attracted to the air bubbles, thereby enhancing the formation of bubble/particle aggregates as to that constituent. Thus, a complete flotation process is conducted in several steps: (1) the feed is ground, usually to a size less than about 28 mesh; (2) a slurry containing about 5 to 40 percent solids in water is prepared; (3) the necessary chemicals are added and sufficient agitation and time provided to distribute the chemicals on the surface of the particles to be floated; (4) the treated slurry is aerated in a flotation cell by agitation in the presence of a stream of air or by blowing air in fine streams through the slurry; and (5) the aerated particles in the froth are withdrawn from the top of the cell as a froth product (frequently referred to as the "concentrate") and the remaining solids and water are discharged from the bottom of the cell (frequently referred to as the "tailing product").

Chemicals useful in creating the froth phase for the flotation process are commonly referred to as "frothers." The most common frothers are short chain alcohols such as methyl isobutyl carbinol, pine oil, and cresylic acid. The criteria for a good frother revolves around the criteria of solubility, toughness, texture, froth breakage, and noncollecting techniques. In practical flotation tests, the size, number, and stability of the bubbles during flotation may be optimized at given frother concentrations.

Much scientific endeavor has been expended toward analyzing the various factors which relate to improving the conditions during flotation for improved recovery of particles. One particular phenomenon that has been known for some time is the poor flotation response of fine particles. This becomes economically important when flotation separation methods are used in the processing of minerals.

Generally, prior art processes have achieved effective flotation for both metallic and non-metallic minerals having a particle size in the range of between 10 and 1000 microns. In these processes, the minimum recoverable particle size has been anywhere from 10 to 100 microns, depending on the particular mineral sought to be recovered. Frequently, the mineral industries have thus been forced to discard the smaller, unrecovered mineral particles since it is uneconomical to concentrate or recover them.

The economic losses suffered by the mineral industries due to this inability to recover very fine minerals by conventional flotation techniques is staggering. For example, in the Florida phosphate industry, approximately $\frac{1}{3}$ of the phosphate is lost as slime. Roughly 1/5 of the world's tungsten and about half of Bolivian tin is lost due to the inefficiencies of present flotation techniques in recovering these minerals. It will thus be appreciated that any process that could recover particles smaller than those recovered in existing prior art processes would have a tremendous economic impact on these and other mineral industries.

The inability of prior art flotation processes to recover fine particles is also important in the coal industry. Flotation processes for separating ash and sulphur from coal have been used with greatly increased frequency during recent years. However, in these flotation separation processes, significant amounts of very fine coal particles go unrecovered. As a result, coal fines may be lost in the reject stream. Not only is this a waste of a valuable resource, but disposal of coal-containing reject streams is frequently a serious environmental problem.

Another factor which further complicates the effectiveness of conventional flotation is that conventional flotation cells generally require a minimal retention time of at least two minutes for successful separation. This is particularly disadvantageous because such relatively long retention times required for conventional flotation processes limit plant capacity and result in large floor space demands.

Surface chemical factors are also important with respect to the potentiality for formation of bubble/particle aggregates in the flotation process. The qualitative interrelationships between hydrophobicity, contact angle, and flotation response are fairly well understood, but there is little quantitative information available on the relationship between hydrophobicity and induction time.

Induction time can be defined as the time taken for a bubble to form a three-phase contact at a solid surface after an initial bubble/particle collision. Alternatively, induction time may be regarded as the time required after collision for the liquid film between a particle and air bubble to thin to its rupture thickness. Induction times which are characteristic of good flotation conditions are known to be of the order of about 10 milliseconds. Whereas the contact angle between a bubble and a particle appears to be an intrinsic characteristic of the surface chemical forces, in an actual flotation system, induction time is dependent on physical factors such as particle size, temperature (in certain circumstances), and inertial effects, as well as being dependent on surface chemical forces. Consequently, in considering bubble-particle contact and adhesion, any calculations involving an induction time factor must, to some extent, be speculative. Nevertheless, such calculations may provide a useful guide to the significance of the induction time factor on affecting flotation rates and the general flotation response of any particle.

Additional discussions relating to flotation and fine particles processing may be found in the following publications:

M. C. Furstenau, editor, *Flotation,* (vols. 1 and 2), American Institute of Mining, Metallurgical, and Petroleum Engineers, Inc. (1976); and P. Somasundaran, editor, *Fine Particles Processing,* Proceedings of the International Symposium on Fine Particles Processing, Las Vegas, Nev., Feb. 24–28, 1980 (vols. 1 and 2), American Institute of Mining, Metallurgical, and Petroleum Engineers, Inc. (1980).

In addition to conventional froth flotation, variations in flotation techniques sometimes include the addition of an emulsion, such as by the addition of about three to five percent or more oil to enhance the formation of oil droplet/coal particle aggregates. When a slurry of ground coal is flocculated with the oil, the flocs which float are separated from the refuse material by skimming from the surface. While this technique does not utilize air bubbles for flotation, the adaptation of this sytem to froth flotation has been used both for coal and a variety of ores such as manganese dioxide and ilmenite (an oxide mineral of iron and titanium). In this latter process, a collector and fuel oil are added to the ore slurry, often with an emulsifier. The conditions of the process are adjusted so that when the slurry is aerated, the dispersed oil/particle suspension inverts from that of oil-in-water in the slurry to one of water-in-oil in the froth. This process, therefore, occupies a middle position between froth flotation and the foregoing oil flotation process. The quantity of oil used is usually much lower than that used for the bulk oil or spherical agglomeration processes; for example only one to several pounds of oil per ton of ore processed is generally used. Such modifications of conventional froth flotation processes are referred to in the art as emulsion or oil flotation.

Flotation techniques can be applied where conventional gravity separation techniques fail. Indeed, flotation has supplanted the older gravity separation methods in solving a number of separation problems. Originally, flotation was used to separate sulphide ores of copper, lead and zinc from associated gangue mineral particles. However, flotation is also used for concentrating nonsulphide ores, for cleaning coal, for separating salts from their mother liquors, and for recovering elements such as sulphur and graphite.

B. Cyclonic Separators

The cyclonic separator (sometimes referred to as a hydrocyclone) is a piece of equipment with utilizes fluid pressure energy to create rotational fluid motion. This rotational motion causes relative movement of the particles suspended in the fluid, thereby permitting separation of particles, one from another or from the fluid.

The rotational fluid motion is produced by tangential injection of fluid under pressure into a vessel. At the point of entry for the fluid, the vessel is usually cylindrical and can remain cylindrical over its entire length, though it is more usual for a portion of the vessel to be conically shaped.

In many instances, the hydrocyclone is used successfully for dewatering a suspension or for making a size separation between the particulates in the suspension (classifying hydrocyclone). However, equally important is its use as a gravity separator. Hydrocyclones have been used extensively as gravity separators in coal preparation plants, and design features have been established for such applications which emphasize the difference in particle gravity rather than the differences in particle size. Two general categories of hydrocyclones used for gravity separation can be distinguished by their design features particularly with respect to their feed and discharge ports and, to a lesser extent, by the presence or absence of a conical section.

The first type of hydrocyclone generally has three inlet and outlet ports and consists of a cylindrical vessel ranging in size (as found in industry) from 2 to 24 inches in diameter with a conical or bowl-shaped bottom. Variations do exist in the shape, dimensions, bottom design, vortex finder, and similar parameters. The choice of the various parameters of the cyclone design depend upon the size of the particles to be treated and the efficiency desired. Thus, the major operating variables of the hydrocyclone are: (a) the vertical clearance between the lower orifice edge of the vortex finder and the cyclone bottom, (b) the vortex finder diameter, (c) the apex diameter, (d) the concentration of feed solids, and (e) the inlet pressure.

In operation, the particle-bearing water slurry is introduced tangentially and under pressure into the cylindrical section of the cyclone where centrifugal forces act upon the particles in proportion to their mass. As the slurry moves downwardly into the conical section of the cyclone, the centrifugal force acting on the particles increases with the decreasing radii of the cyclone. With such a design, the heavy density particles of a given size tend to move outwardly toward the descending water spiral much more rapidly than their lighter density counterparts. Consequently, as these lighter desnity particles approach the apex of the cone, they are drawn into an upwardly flowing, inner water spiral which envelopes a central air core. These lighter density particles then move towards the vortex finder where they are removed as overflow product. The heavier particles in the outer spiral along the cyclone wall move towards the apex orifice of the hydrocylone where they are removed as an underflow product. Admittedly, this is an oversimplified description of the separation affected in a hydrocyclone which is, in fact, a very complex interaction of many physical phenomena including centrifugal acceleration, centripetal drag of the fluid, and mutual impact of particles.

The second type of hydrocyclone used for gravity separation has four inlet/outlet ports and consists of a straight-wall cylindrical vessel of specified length and diameter and is usually operated at various inclined positions ranging between the horizontal and the vertical. A suspension of particles enters the vessel through a coaxial feed pipe (generally at the upper end of the vessel) while a second fluid (typically, water or a heavy media suspension) enters the vessel tangentially, under pressure, through an inlet adjacent the lower end of the vessel. The pumped second fluid thus creates a completely open vortex within the vessel as it transverses the vessel toward a tangential reject discharge adjacent the upper or inlet end. The cyclonic action created in the vessel transports the heavier particles to the reject discharge while the lower density particles are removed from the vessel through a coaxial outlet (vortex finder) at the lower end of the vessel.

Either of the foregoing devices can be used with or without dense media. Hydrocyclones used without dense media for gravity separations are referred to as water-only hydrocyclones and those that are used with dense media are referred to as heavy media hydrocyclones. The dense media usually consists of an aqueous suspension of finely ground magnetite or ferrosilicon to control the specific gravity of the media between the specific gravities of the two components of the feed material. The finely ground media material is recovered from both the overflow and the underflow streams by screening and recycling. As will be readily appreciated, this requirement adds to the cost and complexity of the separation and limits the process with respect to the size of particles which can be separated.

Additional information regarding hydrocyclone separators and their operation may be found in the following publications:

D. Bradley, *The Hydrocyclone*, Pergamon Press (1965);

P. Sands, M. Sokaski, and M. R. Geer, "Performance of the Hydrocyclone as a Fine-Coal Cleaner", *Bureau of Mines Report of Investigations* No. 7067, U.S. Department of the Interior (1968);

A. W. Deurbrouck and J. Hudy, Jr., "Performance Characteristics of Coal-Washing Equipment; Dense-Medium Cyclones", *Bureau of Mines Report of Investigations* No. 7673, U.S. Department of the Interior, 1972.

A. W. Deurbrouck, "Performance Characteristics of Coal-Washing Equipment Hydrocyclones", *Bureau of Mines Report of Investigations*, No. 7891, U.S. Department of the Interior, (1974); and E. J. O'Brien and K. H. Sharpeta, "Water-Only Cyclones; Their Functions and Performance", *Coal Age* at 110–14 (January 1976).

Surprisingly, it has been discovered that flotation can be accomplished in a centrifugal field for improved efficiencies in the recovery of particles, particularly with respect to those particles which are conventionally considered too small to be recovered by gravity separators and which do not respond well in conventional froth flotation systems in a gravitational field. An apparatus and method implementing this discovery is disclosed and claimed herein.

BRIEF SUMMARY AND OBJECTS OF THE INVENTION

The present invention relates to a novel apparatus and method for separating particles from a fluid, particulate suspension by flotation in a centrifugal field. The apparatus includes a vertically oriented, cylindrical vessel having a tangential inlet at the upper end thereof for introducing the particulate suspension under pressure into the vessel in a generally tangential fashion, and a tangential outlet at the lower end thereof for directing fluid discharge from the particulate suspension out of the vessel in a generally tangential fashion.

The novel configuration of the vessel with its tangential inlet and outlet, directs the particulate suspension around the vessel in a swirling motion such that the particulate suspension forms a thin fluid layer around the inner surface of the vessel wall. The unique design of the apparatus also directs the flow of the particulate suspension so as to create a forced vortex in the vessel; the forced vortex, in turn, forms a centrifugal field. A portion of the vessel wall is formed as a porous wall, and the porous wall is surrounded by an air plenum in communication with an air source.

The particulate suspension is first introduced into the vessel through the tangential inlet and forms a thin fluid layer against the inside surface of the vessel wall. Air inside the air plenum is then injected through the porous wall and into the thin fluid layer of particulate suspension within the vessel. The air bubbles and particles within the fluid suspension form bubble/particle aggregates which float to the "top" of the centrifugal force field, i.e., the axial center of the apparatus. As air is sparged through the porous wall into the thin fluid layer, very small air bubbles are formed by the high shear velocity of the fluid suspension against the porous wall. As the air bubbles form, they are constrained momentarily against the porous wall so as to increase the collision rate between the air bubbles and the particles in the fluid suspension. The remaining fluid then exits the tangential outlet as discharge. The rate of the fluid discharged through the outlet can be regulated so as to control the water split within the vessel.

Because of the thin fluid layer in which flotation occurs, flotation is achieved rapidly in this novel apparatus and method, and the retention time for the entire separation process is on the order of seconds, depending on the length of the vessel.

It is, therefore, an object of the present invention to provide an apparatus and method for separating particles from a fluid suspension by flotation in a centrifugal field which achieves separation of fine particles which are significantly smaller than particles separated by prior art methods and apparatus.

Another object of the present invention is to provide an apparatus and method for separating particles from a fluid suspension by flotation in a centrifugal field in which flotation occurs in a thin fluid layer of the particulate suspension and which signficantly increases the collision rate between the particles and the air bubbles, thereby substantially increasing the degree of separation achieved and allowing the separation process to be performed rapidly.

Still another object of the present invention is to provide an improved flotation apparatus and method in which the fluid flow forms a forced vortex so as to enhance the formation of a quiescent froth and optimize recovery of the particles from the fluid suspension.

A further object of the present invention is to provide a flotation apparatus and method which achieves a favorable water split and which allows the water split to be controlled.

Yet another object of the present invention is to provide an apparatus for separating particles from a fluid suspension by flotation in a centrifugal field which is relatively compact and does not require large amounts of floor space.

These and other objects of the present invention will become more fully apparent from the following description and appended claims, taken in conjunction with the accompanying drawing.

DETAILED DESCRIPTION OF THE PREFERRED EMBODIMENT

Figure 1:
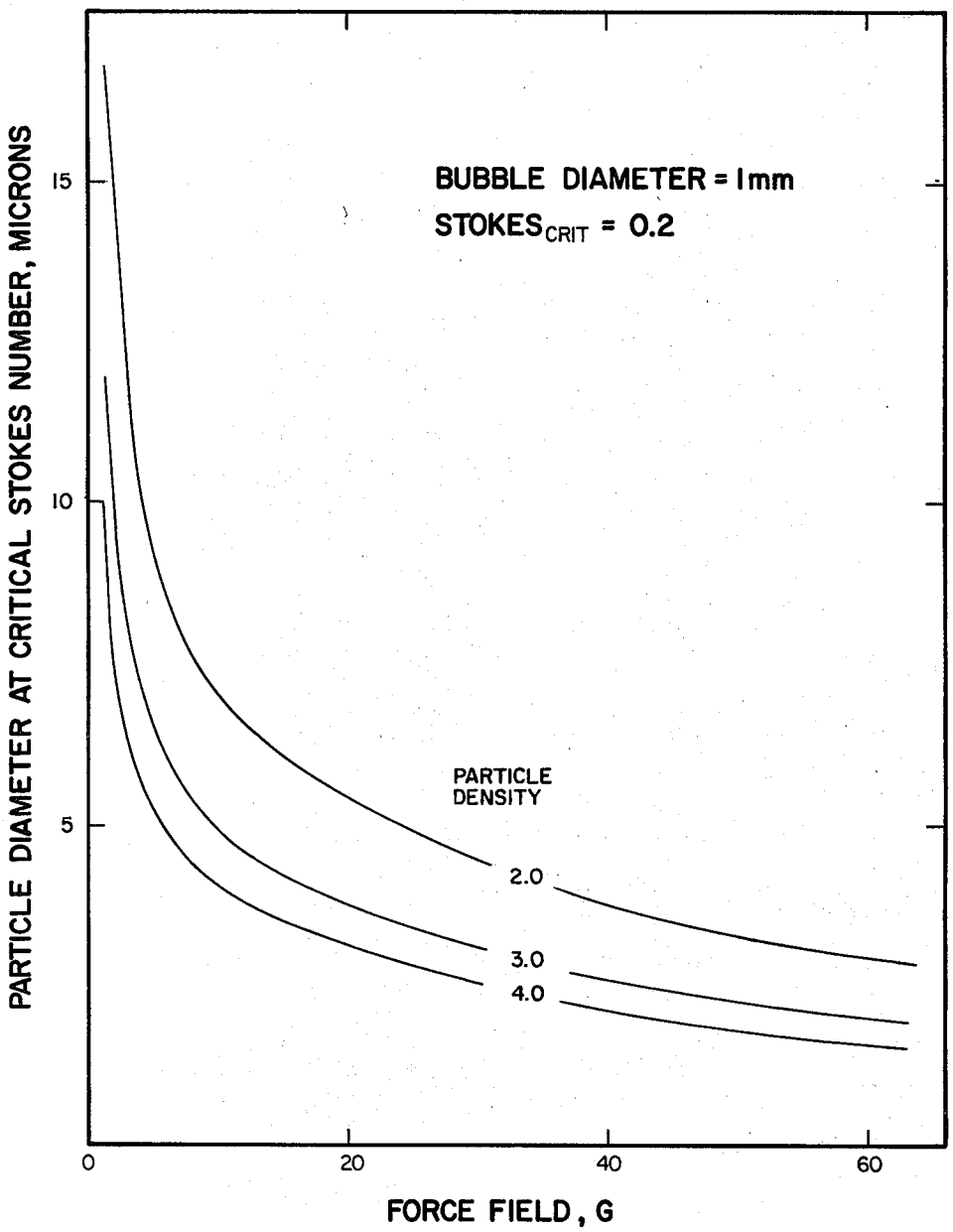
FIG. 1 is a graph comparing the minimum particle diameter that will impact an air bubble as a function of the force field at a critical Stokes number of 0.2.

The present invention is better understood in view of my related applications entitled FLOTATION APPARATUS AND METHOD FOR ACHIEVING FLOTATION IN A CENTRIFUGAL FIELD, Ser. No. 182,524, filed Aug. 29, 1980; and AIR-SPARGED HYRDOCYCLONE AND METHOD, Ser. No. 094,521, filed Nov. 15, 1979, which issued as U.S. Pat. No. 4,279,743 on July 21, 1981; which application and patent are incorporated herein by reference.

The present invention can be best understood by reference to the drawing wherein like parts are designated by like numerals throughout.

GENERAL DISCUSSION

As discussed in detail in my copending application entitled "FLOTATION APPARATUS AND METHOD FOR ACHIEVING FLOTATION IN A CENTRIFUGAL FIELD," experimental studies with certain embodiments of the apparatus and method disclosed in that application have shown that the rate of flotation generally increases as bubble size decreases. This phenomenon is also true of the novel apparatus and method of the present invention. Moreover, further experimentation with the apparatus and method of the present invention indicates that by performing flotation in a centrifugal field the rate of flotation can be increased and the size limit of fine particles which can be separated is extended.

Considering the probability of collision and attachment of a particle to a bubble from the standpoint of inertial impaction, a lower limit on particle size can be defined below which impaction will not occur. Those particles smaller than the size limit have insufficient inertia to deviate from the fluid streamlines. The Stokes number, which is a measure of the ratio of inertial forces to viscous forces, is a convenient criterion to determine the extent to which particles will deviate from streamlines and undergo intertial impaction with a bubble. The minimum or critical size of the particles which may be separated by flotation depends to a large extent on the magnitude of the force field experienced by the particles in the fluid suspension.

It has been recognized in the literature that from theoretical considerations (which have been experimentally verified) that a Stokes number in the range of below about 0.2 is the critical number below which inertial impaction of the particles with the bubbles will not occur. Assuming a critical Stokes number of 0.2, FIG. 1 shows the relation of the critical particle size to the force field experienced. Note that as the force field increases, the critical particle size needed for initial impaction drops significantly. For a force field of 1 G, the critical particle size for impaction is on the order of from 10–100 microns; this is the range in which the prior art flotation apparatus function. However, as the force field increases, the critical particle size drops dramatically, reaching a size of 1 micron at about 100 Gs.

In one embodiment of the present invention, centrifugal force fields of at least 50 Gs or greater can be achieved, extending the fine particle flotation size limit towards 1 micron, and increasing the rate of flotation to about 300 times the rate experienced in the existing prior art apparatus and processes.

THE APPARATUS

Figure 2:
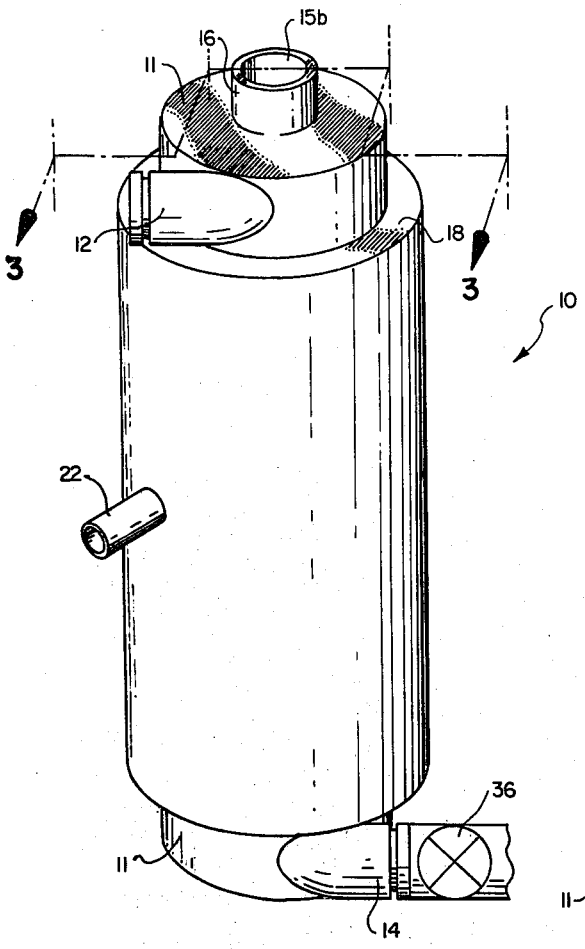
FIG. 2 is a perspective view of a preferred embodiment of the novel apparatus of the present invention.
Figure 3:
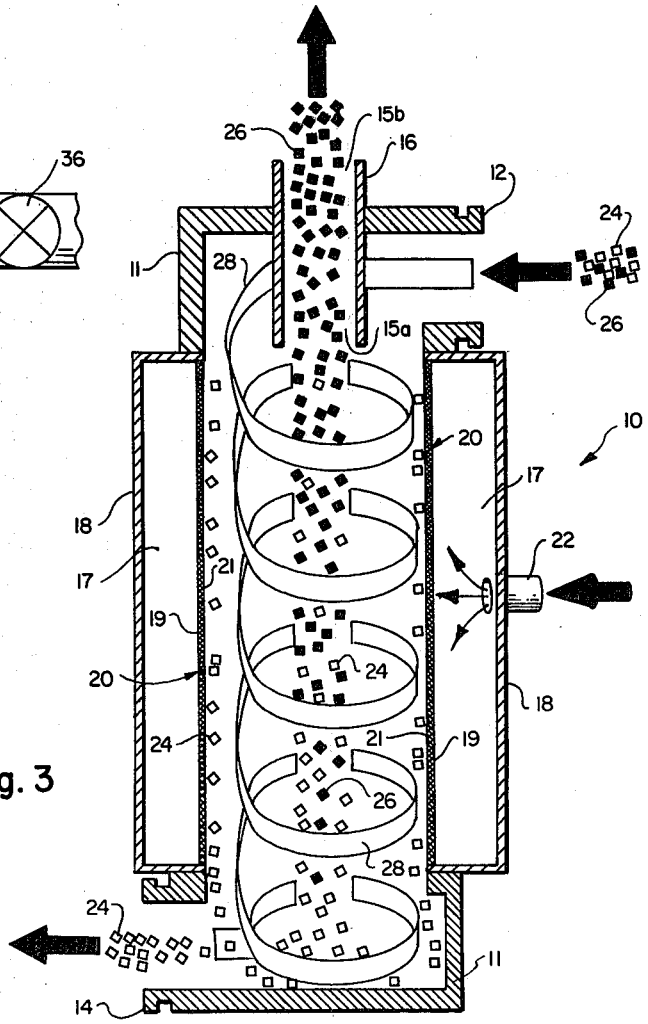
FIG. 3 is a longitudinal cross-sectional view of the preferred embodiment of the apparatus of FIG. 2 taken along line 3—3, which further illustrates the operation of that apparatus in separating hydrophobic particles from a fluid, particulate suspension containing both hydrophobic and hydrophilic particles.

One preferred embodiment of the present invention is best illustrated in FIGS. 2 and 3. The apparatus for separating particles from a fluid suspension by flotation in a centrifugal field, generally designated 10, includes a generally cylindrical housing or vessel 11 which is preferably vertically oriented. A generally tangential inlet 12 is formed at the upper end of cylindrical flotation vessel 11 for receiving the particulate suspension to be treated. A generally tangential outlet 14 is formed at the lower end of vessel 11 for directing fluid discharge from the particulate suspension out of vessel 11 in a generally tangential fashion. A valve 36 is installed in outlet 14 to regulate the flow rate of fluid discharge therethrough.

A portion of the wall of vessel 11 is formed as a porous wall, generally designated 20, having an outer surface 19 and an inner surface 21. An annular air plenum 18 is formed around porous wall 20 so as to completely enclose porous wall 20 and form an air plenum chamber 17 therebetween. An air inlet 22 formed in air plenum 18 is in communication with an air source (not shown) to accommodate introduction of air into chamber 17.

A cylindrical vortex finder 16 is mounted to the upper end of flotation vessel 11. Ports **15*a* and 15*b* are formed in the ends of the hollow vortex finder 16** to permit the passage of froth therethrough.

THE METHOD

The operation of flotation apparatus 10 and one preferred embodiment of the novel method of the present invention are best understood by reference to FIG. 3. A particulate suspension (sometimes referred to as a "slurry feed") containing finely divided hydrophilic particles 24 (illustrated by light-colored boxes) and hydrophobic particles 26 (illustrated by dark-colored boxes) is introduced into vessel 11 through tangential inlet 12 so as to follow the course indicated by spiral pathway 28. (Prior to the introduction of the particulate suspension into vessel 11, if particles 26 are not naturally hydrophobic, they should be made hydrophobic by methods known in the art.) The particulate suspension is injected into inlet 12 under pressure and in a generally tangential fashion so as to assume the swirling path illustrated by spiral pathway 28.

Thus injected, the particulate suspension forms a thin fluid layer 40 (see FIG. 4) against the inner surface 21 of porous wall 20 (to be explained in more detail hereinafter). Air is then introduced from air inlet 22 into chamber 17 of air plenum 18 and is sparged through porous wall 20 into the thin fluid layer 40 of the particulate suspension.

Upon entry into thin fluid layer 40, the air forms small bubbles which attach to and/or trap the hydrophobic particles 26 and transport them out through the centrifugal field to the axial center of flotation apparatus 10. The hydrophilic particles 24 are not trapped by the air bubbles and follow the swirl flow of the thin fluid layer 40 in the centrifugal field along the inner surface 21 of porous wall 20. Hydrophilic particles 24 follow the thin fluid layer 40 downward and leave the vessel 11 tangentially with the fluid discharge through tangential outlet 14. The hydrophobic particle-containing bubbles congregate at the core of vessel 11 to form a froth 34 (see FIG. 4) which travels upwardly through the vessel 11 and is discharged from the vessel through vortex finder 16.

The apparatus and method of the present invention serve to maximize the attachment of hydrophobic particles 26 to air bubbles and thus increase the degree of separation of the hydrophobic particles 26 from the particulate suspension. This is due in part to the fact that flotation occurs in a centrifugal field where the probability of collision and subsequent attachment of the air bubbles to hydrophobic particles 26 is greatly enhanced. Thus, the novel apparatus and method of the present invention take full advantage of the affinity of the hydrophobic particles 26 for the air bubbles in achieving maximal separation of the hydrophobic particles 26.

It will be appreciated that the same apparatus and method may be used to separate finely divided hydrophobic particles, or finely divided particles which are made hydrophobic, from a particulate suspension containing no other particles. This is the application which is set forth in FIG. 4. In this process, which will be described in more detail hereinafter, there are of course, no hydrophilic particles 24 in the fluid discharge.

Figure 5:
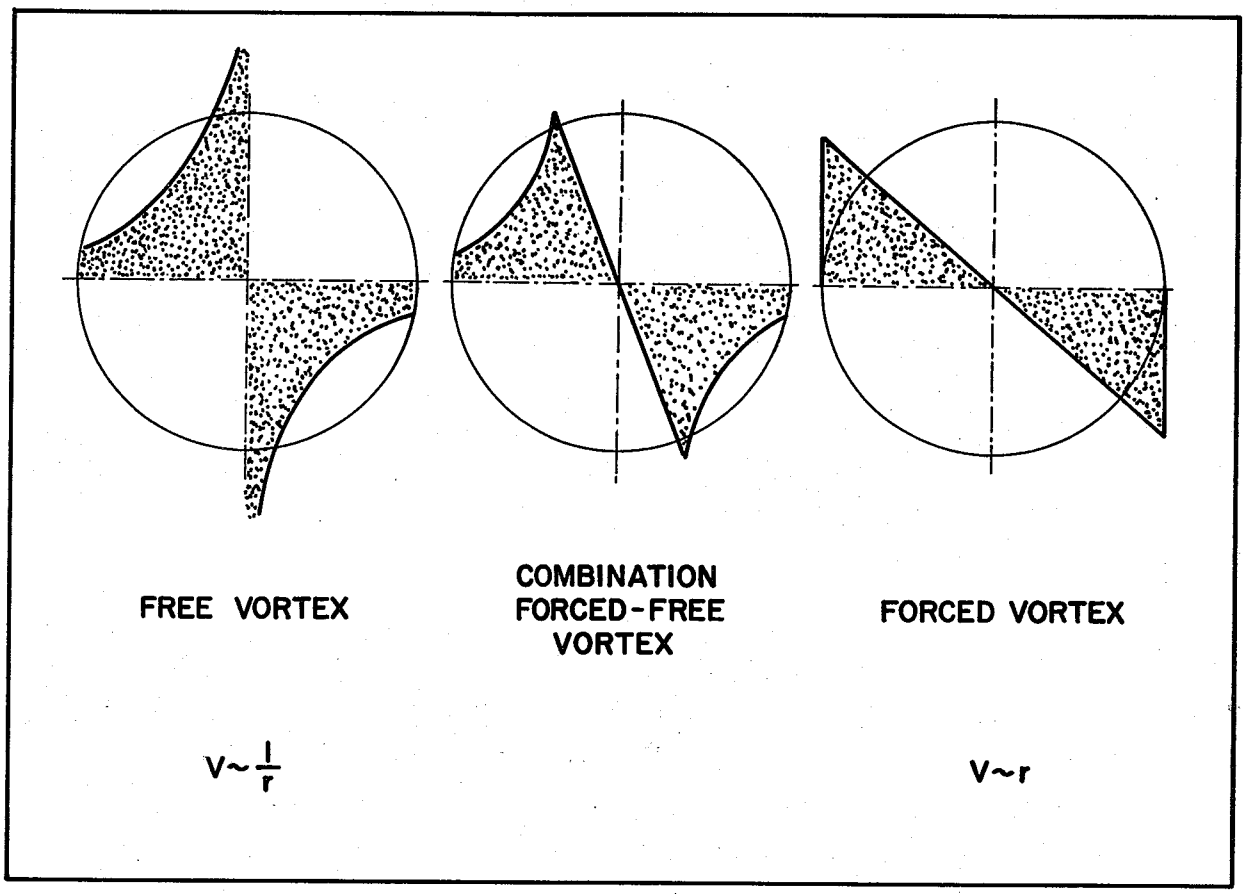
FIG. 5 is a chart showing the tangential velocity distribution of different types of vortices created by the rotational motion of the fluid flow in different hydrocyclone devices. The shaded areas correspond to the magnitude of the tangential velocity along the diameter of each different apparatus. (Note that V=tangential velocity and r=radius.)

There are several significant advantages associated with the novel apparatus and method for separating particles from a fluid suspension by flotation in a centrifugal field. For example, the generally tangential orientation of inlet 12 and outlet 14 cause the injected particulate suspension to form a forced vortex within vessel 11—the forced vortex creating a centrifugal field. FIG. 5 illustrates the tangential velocity distribution in forced, free, and combination forced-free vortex systems. As seen in FIG. 5, in a free vortex system, the tangential velocity is maximal at an intermediate distance from the center of the apparatus. Free vortices tend to occur in systems where the majority of the flow leaves the apparatus axially.

In a forced vortex system, the whole fluid system rotates at the same angular velocity. Hence, a forced vortex system results in a wheel-like motion with the tangential velocity of the fluid decaying to zero in the direction of the axial center of the apparatus. Consequently, a quiescent froth 34 is more easily formed and stabilized in a forced vortex system. Forced vortices tend to occur in systems where the majority of the fluid flow leaves the apparatus tangentially, such as in the preferred embodiment of the novel apparatus discussed hereinabove.

A combination forced-free vortex system can be created by combining the features characteristic of forced vortex and free vortex systems, yielding a tangential velocity distribution which is somewhat of a hybrid of the forced and free vortex systems (see FIG. 5). It should be emphasized that the novel apparatus and method of the present invention serve to optimize the forced nature of the vortex created, which in turn enhances the formation of a quiescent froth and optimizes the quantity of bubble/particle aggregates which are recovered from the particulate suspension.

Another important advantage of the novel apparatus and method of the present invention is the low water split which is achieved. The water split may be defined as the ratio of the amount of water in the particle-containing froth 34 to the amount of water in the slurry feed. It is highly desirable to minimize the amount of water in the froth 34, thereby minimizing the water split.

One important factor to achieving a low water split is the tangential orientation of both inlet 12 and outlet 14. A tangential inlet and outlet assures that the particles will be subjected to sufficient centrifugal forces to keep water out of the froth phase. Other geometries such as conventional hydrocyclones with conical bottoms and axial discharge result in significant transport of water through the vortex finder into overflow product. Moreover, the vertical orientation of vessel 11 is in part responsible for the advantageously low water split achieved in the present invention. The vertical orientation of the vessel 11 maximizes the drainage of fluid from the froth 34 and the overflow product which is moving upwardly in a vertical direction, because the vertical orientation utilizes gravity to its maximum extent and gravity is a major force acting on the water in the froth 34.

As the bubble/particle aggregates reach the core of vessel 11, they congregate to form froth 34 which travels upwardly towards the vortex finder 16, exiting vessel 11 therethrough. Due to the favorable water split obtained by the present invention, the particle-containing froth 34 contains a minimum amount of water. Since froth 34 travels countercurrently to the thin fluid layer 40 and since the vessel 11 is vertically oriented, water drainage from froth 34 is further enhanced, thus resulting in the low water split.

Another structural feature of the present invention which helps achieve the desired low water split is valve 36 which controls the flow of the fluid discharge through outlet 14. By opening up valve 36, the fluid discharge can be removed at a rate sufficient to prevent the bottom portion of vessel 11 from filling up with the fluid discharge. This, in turn, helps to maintain a quiescent froth 34 in the core of the vessel 11. With valve 36 adjusted to a more reduced outlet flow, the froth 34 can occupy more than 90% of the volume of vessel 11 inside thin fluid layer 40. It will be appreciated that valve 36 is shown by way of example only, and that any conventional means for regulating the rate of fluid flow through outlet 14 may be employed.

Figure 4:
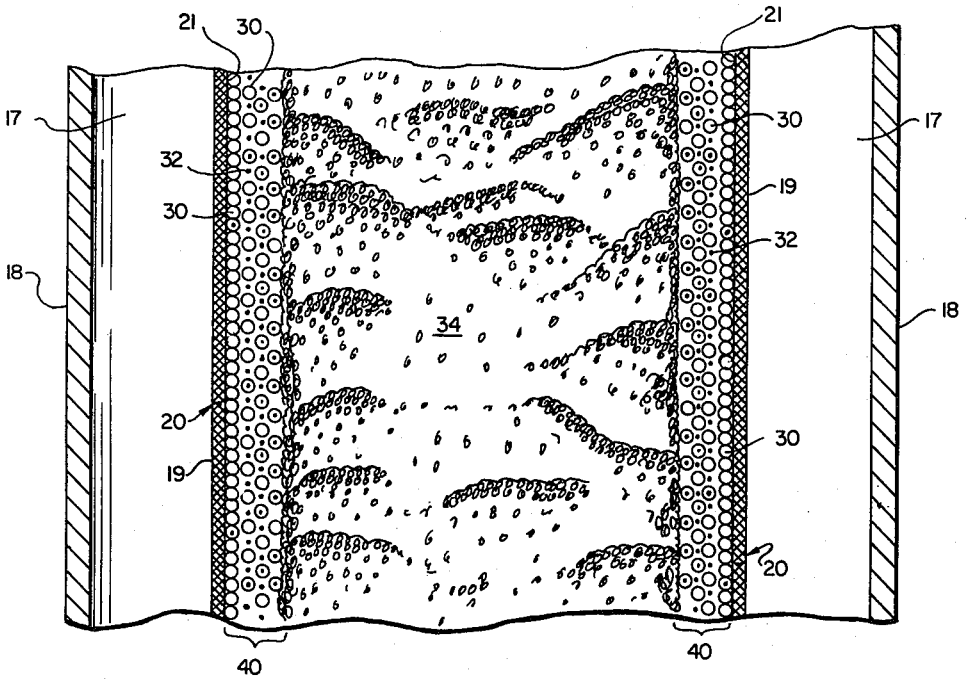
FIG. 4 is a partial, longitudinal cross-sectional view of the preferred embodiment of the apparatus of FIG. 2, enlarged to better show the operation of that apparatus in separating hydrophobic particles from a fluid, particulate suspension containing only hydrophobic particles.

Referring now to FIG. 4, the importance of the thin fluid layer 40 and the separation of particles 32 from a particulate suspension is illustrated. Fine particles 32, if not already hydrophobic, can be made hydrophobic by treatment with certain chemicals, such treatment making possible the separation of fine particles 32 by flotation. (Fine particles 32 shown in FIG. 4 thus correspond to hydrophobic particles 26 shown in FIG. 3.) As seen in FIG. 4, as the air is introduced from chamber 17 of air plenum 18 through porous wall 20 into the thin fluid layer 40, small air bubbles are formed along the inner surface 21 of porous wall 20. The high shear velocity of the particulate suspension in thin fluid layer 40 creates a continual generation of very small air bubbles and provides for intense contact of particles 32 with bubbles 30.

Moreover, during their formation, air bubbles 30 are momentarily constrained against the inner surface 21 of porous wall 20. This temporary fixation of the air bubbles 30 to inner porous wall surface 21, together with the directed motion of the particulate suspension toward the constrained air bubbles 30, considerably increases the probability of collision between air bubbles 30 and particles 32 in the thin fluid layer 40. In a conventional flotation cell, air bubbles and particles are mixed together at random, and the probability that a particle and bubble will meet with sufficient velocity to form a particle/bubble aggregate is considerably less than the probability that such an occurence will take place in the thin fluid layer system of the present invention.

Additionally, since the thin fluid layer 40 of the present invention occupies less than 10% of the volume of vessel 11, flotation is achieved rapidly. This is because the bubbles 30 need only arrive at the boundary between thin fluid layer 40 and froth 34 before flotation is complete. Indeed, flotation is achieved up to 300 times faster in the present invention than in most conventional flotation cells. It will be appreciated, as discussed above, that the tangential outlet 14 and discharge regulating valve 36 accommodate the maintenance of thin fluid layer 40 as well the froth 34, by permitting discharge in such a manner and at such a rate so as not to disturb the thin fluid layer 40 or froth 34.

It will be understood that the generation of a large number of very small air bubbles 30 (accomplished in part by the high shear velocity of the particulate suspension) and the constrained particle/bubble interaction (instead of random particle/bubble interaction) within thin fluid layer 40 are very important to the novel apparatus and method of the present invention and the extraordinary flotation results obtained thereby.

It should also be noted that the separation achieved by the novel apparatus and method of the present invention has been shown experimentally to be due primarily to the improved flotation techniques of the present invention, not to be due to factors which would cause separation of the particles by size. That is to say, the present invention does not show evidence of separating by size the particles which are in suspension; on the contrary, the present invention separates the particles according to flotation principles. This means that a particulate product can be recovered from a fluid suspension by the flotation techniques of the present invention even though that product is comprised of particles over a broad range of particle sizes and even though there may be other components in the suspension within the same range of particle sizes.

As mentioned previously, the retention time of the particulate suspension from the time it enters inlet 12 to the time the fluid discharge exits outlet 14, is a matter of seconds, thus providing for a much more rapid separation than is achieved in conventional flotation cells. This, in turn, allows flotation apparatus 10 to be constructed much smaller than conventional flotation cells, thereby eliminating the need for large floor space to operate the apparatus. It will be appreciated that the retention time is also influenced by the length of the porous wall 20 and the amount of air sparged therethrough. Consequently, porous wall 20 may be constructed with a length that will provide the most desirable retention time for a given application.

It will be understood that the invention may be embodied in other specific forms without departing from its spirit or essential characteristics. For example, instead of the verticle orientation of flotation apparatus 10, as shown in FIGS. 2 and 3, the flotation appparatus 10 may be inclined slightly as desired. The described embodiments are thus, to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An apparatus for separating particles from a particulate suspension by flotation in a centrifugal field, comprising:

a generally vertically oriented vessel having a generally cylindrical configuration;

an inlet at the upper end of the vessel for introducing a particulate suspension under pressure into the vessel in a generally tangential fashion;

an outlet at the lower end of the vessel for directing fluid discharge from said particulate suspension out of the vessel in a generally tangential fashion, said inlet and outlet directing fluid flow so as to create a forced vortex in the vessel, said forced vortex forming a centrifugal field; and means for introducing air into said particulate suspension, the air forming small bubbles which separate the particles from the particulate suspension by flotation in the centrifugal field.

2. An apparatus as defined in claim 1 wherein the inlet is configurated so as to direct the particulate suspension around an inner surface of the vessel in such a manner that the particulate suspension forms a thin fluid layer within the vessel.

3. An apparatus as defined in claim 1 further comprising means for controlling flow rate of the fluid discharge through the outlet.

4. An apparatus as defined in claim 1 wherein at least a portion of a wall of the vessel comprises a porous wall, and wherein the air introducing means comprises an air plenum surrounding the porous wall portion of the vessel, the porous wall providing for the passage of air from the air plenum into the particulate suspension within the vessel.

5. An apparatus as defined in claim 1 wherein the air bubbles congregate within the vessel to form a froth and further comprising a vortex finder positioned at the upper end of the vessel so as to guide the froth coaxially out of the vessel.

6. An apparatus for separating particles by flotation in a thin fluid layer, comprising:

a generally vertically oriented vessel having a generally cylindrical configuration, at least a portion of a wall of the vessel comprising a porous wall;

an inlet at the upper end of the vessel for introducing a particulate suspension under pressure into the vessel in a generally tangential fashion, the inlet being configurated so as to direct the particulate suspension into the vessel in such a manner that the particulate suspension forms a thin fluid layer around the inner surface of the wall of the vessel;

an outlet at the lower end of the vessel for directing fluid discharge from the particulate suspension out of the vessel in a generally tangential fashion, the inlet and the outlet directing fluid flow so as to create a forced vortex in the vessel, the forced vortex forming a centrifugal field;

means for controlling flow rate of the fluid discharge through the outlet; and an air plenum surrounding the porous wall portion of the vessel, the porous wall providing for the passage of air from the air plenum into the thin fluid layer within the vessel.

7. A method for separating particles from a fluid suspension by flotation in a centrifugal field, comprising the steps of:

obtaining a generally vertically oriented vessel having a generally cylindrical configuration;

introducing a fluid suspension into the upper end of the vessel in a generally tangential fashion;

forming a centrifugal field in the vessel by creating a forced vortex in the vessel;

sparging air into the fluid suspension, the air forming small bubbles which separate the particles from the fluid suspension leaving a fluid discharge; and directing the fluid discharge out of the lower end of the vessel in a generally tangential fashion.

8. A method as defined in claim 7 further comprising the step of regulating flow rate of the fluid discharge from the vessel.

9. A method as defined in claim 7 further comprising the step of maintaining the fluid suspension within the vessel as a thin fluid layer against an inner surface of the vessel.

10. A method as defined in claim 7 wherein at least a portion of a wall of the vessel comprises a porous wall and wherein the sparging step comprises introducing air through the porous wall and into the fluid suspension within the vessel, the air forming bubbles within the fluid suspension.

11. A method as defined in claim 10 further comprising the step of generating the air bubbles at the porous wall so as to promote directed collision between the air bubbles and the particles in the fluid suspension.

12. A method as defined in claim 7 further comprising the steps of forming a particle-containing froth within the vessel and removing the froth from a coaxial outlet formed in the top of the vessel.

13. A method for separating particles from a fluid suspension by flotation in a centrifugal field, comprising the steps of:

obtaining a vessel having a generally circular cross-section;

introducing a fluid suspension into the vessel so as to form a thin layer against an inner surface of the vessel and so as to create a forced vortex in the vessel, the forced vortex forming a centrifugal field; and sparging air into the thin layer of fluid suspension, the air forming bubbles which separate the particles from the fluid suspension by flotation.

14. A method for separating particles from a fluid suspension of particles by flotation in a thin layer of the fluid suspension, comprising the steps of:

obtaining a generally vertically oriented vessel having a generally cylindrical configuration, at least a portion of a wall of the vessel comprising a porous wall;

introducing a fluid supension into the vessel in a generally tangential fashion such that the fluid suspension swirls around an inner surface of the wall of the vessel and forms a thin layer thereagainst;

forming a centrifugal field in the vessel by creating a forced vortex in the vessel;

sparging air through the porous wall and into the thin layer of fluid suspension within the vessel, the air forming small bubbles which separate the particles from the fluid suspension leaving a fluid discharge;

directing the fluid discharge out of the vessel in a generally tangential fashion;

regulating flow rate of the fluid discharge from the vessel;

forming a particle-containing froth within the vessel; and removing the froth coaxially from the vessel.

15. A method as defined in claim 14 further comprising the step of generating the air bubbles at the porous wall so as to promote directed collision between the air bubbles and the particles in the fluid suspension, thereby increasing the rate of collision of the air bubbles with the particles in the fluid suspension.

* * * * *

UNITED STATES PATENT AND TRADEMARK OFFICE

CERTIFICATE OF CORRECTION

PATENT NO. : 4,397,741

DATED : August 9, 1983

INVENTOR(S) : Jan D. Miller

It is certified that error appears in the above—identified patent and that said Letters Patent is hereby corrected as shown below:

Column 4, line 3, "with utilizes" should be --which utilizes--

Column 4, line 52, "desnity" should be --density--

Signed and Sealed this

*Twenty-second* Day of *November 1983*

[SEAL]

*Attest:*

GERALD J. MOSSINGHOFF

*Attesting Officer*

*Commissioner of Patents and Trademarks*